US008323046B1

(12) United States Patent
Daugherty et al.

(10) Patent No.: US 8,323,046 B1
(45) Date of Patent: Dec. 4, 2012

(54) BI-DIRECTIONAL CPA MEMBER TO PREVENT UNMATING OF MULTIPLE CONNECTORS

(75) Inventors: James D. Daugherty, Brookfield, OH (US); Mark D. McCall, Hubbard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/113,301

(22) Filed: May 23, 2011

(51) Int. Cl.
*H01R 13/627* (2006.01)

(52) U.S. Cl. ..... 439/352

(58) Field of Classification Search ..... 439/352, 439/489

See application file for complete search history.

(56) References Cited

U.S. PATENT DOCUMENTS

| | | | | | |
|---|---|---|---|---|---|
| 4,370,013 | A * | 1/1983 | Niitsu et al. | 439/352 |
| 5,026,298 | A * | 6/1991 | Brussalis et al. | 439/358 |
| 5,174,786 | A * | 12/1992 | Kato et al. | 439/489 |
| 5,507,666 | A * | 4/1996 | Yamanashi | 439/489 |
| 5,628,648 | A * | 5/1997 | Higgins et al. | 439/489 |
| 5,651,689 | A * | 7/1997 | Plyler et al. | 439/352 |
| 5,681,178 | A * | 10/1997 | Kunkle et al. | 439/352 |
| 5,707,248 | A * | 1/1998 | Matsumura | 439/489 |
| 5,775,930 | A * | 7/1998 | Model et al. | 439/352 |
| 5,947,763 | A * | 9/1999 | Alaksin | 439/489 |
| 6,068,507 | A * | 5/2000 | Popa | 439/489 |
| 6,196,860 | B1 * | 3/2001 | Okayasu et al. | 439/404 |
| 6,257,915 | B1 * | 7/2001 | Endo | 439/357 |
| 6,261,116 | B1 * | 7/2001 | Ceru | 439/352 |
| 6,435,895 | B1 * | 8/2002 | Fink et al. | 439/352 |
| 6,514,098 | B2 * | 2/2003 | Marpoe et al. | 439/352 |
| 6,579,118 | B2 * | 6/2003 | Endo | 439/489 |
| 6,780,045 | B2 * | 8/2004 | Shuey et al. | 439/489 |
| 6,857,892 | B2 * | 2/2005 | McLauchlan et al. | 439/352 |
| 7,114,982 | B2 * | 10/2006 | Shimizu et al. | 439/358 |
| 7,201,599 | B2 * | 4/2007 | Holub | 439/357 |
| 7,326,074 | B1 * | 2/2008 | Lim et al. | 439/352 |
| 7,601,019 | B2 | 10/2009 | Hsieh et al. | |
| 7,785,146 | B2 * | 8/2010 | Chazottes et al. | 439/595 |
| 8,016,606 | B1 * | 9/2011 | Kwan et al. | 439/352 |
| 8,062,049 | B2 * | 11/2011 | Tobey | 439/345 |
| 8,070,510 | B2 * | 12/2011 | Urano et al. | 439/489 |

* cited by examiner

*Primary Examiner* — Amy Cohen Johnson
*Assistant Examiner* — Vladimir Imas
(74) *Attorney, Agent, or Firm* — Thomas N. Twomey

(57) ABSTRACT

A ganged electrical connection system includes a plurality of first connectors matable to a plurality of second connectors along mating axes, and a connector position assurance (CPA) member. The CPA member includes a plurality of tabs and a plurality of release fingers. The plurality of first connectors include a plurality of lock arms and the plurality of second connectors include a plurality of inclined ramps. The plurality of tabs receive the plurality of lock arms and the plurality of inclined ramps deflectingly engage said plurality of release fingers to allow movement of the CPA member in to a position of the CPA member, that when disposed in the position, keeps the plurality of second connectors from unmating from the plurality of coupled first connectors. Methods of fabricating an electrical connection system and a ganged electrical connection system that include the CPA member are also presented.

20 Claims, 14 Drawing Sheets

BI-DIRECTIONAL CPA MEMBER TO PREVENT UNMATING OF MULTIPLE CONNECTORS

RELATED DOCUMENTS

This application is related to U.S. non-provisional application U.S. Ser. No. 13/113,286 entitled "ELECTRICAL CONNECTION SYSTEM THAT ABSORBS MULTI-CONNECTOR POSITIONAL MATING TOLERANCE VARIATION," and non-provisional application U.S. Ser. No. 13/113,313 entitled "ELECTRICAL CONNECTION SYSTEM HAVING DIELECTRIC SPRING TO ABSORB AXIAL POSITIONAL MATING TOLERANCE VARIATION FOR MULTIPLE CONNECTORS," that are each co-owned by the assignee of this application and are incorporated by reference herein. The instant U.S non-provisional application and the abovementioned non-provisional applications have been harmoniously filed on the same day of 23 May 2011.

TECHNICAL FIELD

This invention relates to electrical connection systems utilizing a connector position assurance (CPA) component.

BACKGROUND OF INVENTION

It is known to use a connector position assurance (CPA) component in an electrical connection device to ensure that one connector remains fully mated with a corresponding connector when the electrical connection device is disposed in an electrical application.

In many such connection device configurations, a CPA component is used to ensure two halves of an electrical connection device remain mated so as to keep the two halves from inadvertently unmating from each other during normal use of the electrical connection device. Often, the two halves of the connection device contain more than one termination that also correspondingly mate together when the two connector halves are mated. As electrical connection devices continue to be a mainstay in many electrical applications and circuits, and the need to ensure these electrical connection devices remain robustly mated during normal operation also persists, it remains desirable to utilize CPA components. Some electrical applications, however, may require the mating of numerous electrical connectors in a single electrical connection system configuration while also ensuring that these numerous electrical connectors remain mated during routine, or normal use of the electrical connection system.

Thus, what is needed is an electrical connection system that includes a CPA member that robustly, consistently, and repeatedly ensures connector devices remain mated regardless of the number of connector devices used in a configuration.

SUMMARY OF THE INVENTION

In accordance with one aspect of the invention, a ganged electrical connection system includes a plurality of first connectors, a plurality of second connectors and a connector position assurance (CPA) member. The plurality of first connectors are matable to the plurality of second connectors along mating axes. The CPA member includes a plurality of tabs and a plurality of release fingers. The plurality of first connectors include a plurality of lock arms and the plurality of second connectors include a plurality of inclined ramps.

When the plurality of tabs receive the plurality of lock arms and the plurality of inclined ramps deflectingly engage the plurality of release fingers, the CPA member is moveable to a position, that when disposed in the position, keeps the plurality of second connectors from unmating from the plurality of coupled first connectors.

Methods to fabricate the electrical connection system and the ganged electrical connection system that include the CPA member are also presented.

These and other advantageous features as disclosed in the embodiments of the present invention will be become apparent from the following brief description of the drawings, detailed description, appended claims and drawings.

BRIEF DESCRIPTION OF THE DRAWINGS

This invention will be further described with reference to the accompanying drawings in which.

DETAILED DESCRIPTION

A connector position assurance (CPA) member ensures that fully mated connectors in an electrical connection system remain mated so that an undesirable inadvertent disconnect event that may unmate these connectors does not occur. Should an undesirable unmating event occur, electrical components electrically connected with the electrical connection system may be rendered electrically inoperative. For example, an inadvertent unmating of the connectors may occur if undue applied force due to a stress or strain in the electrical application urges the connectors apart when it is otherwise desired that this unmating not occur. When an electrical connection system has an increased number of connectors this may only increase the importance of keeping these plurality of connectors connected and the electrical components or systems in connection with the plurality of connectors operative. Each of these connectors contained in the electrical connection system may include one or more electrical terminals.

Figure 1:
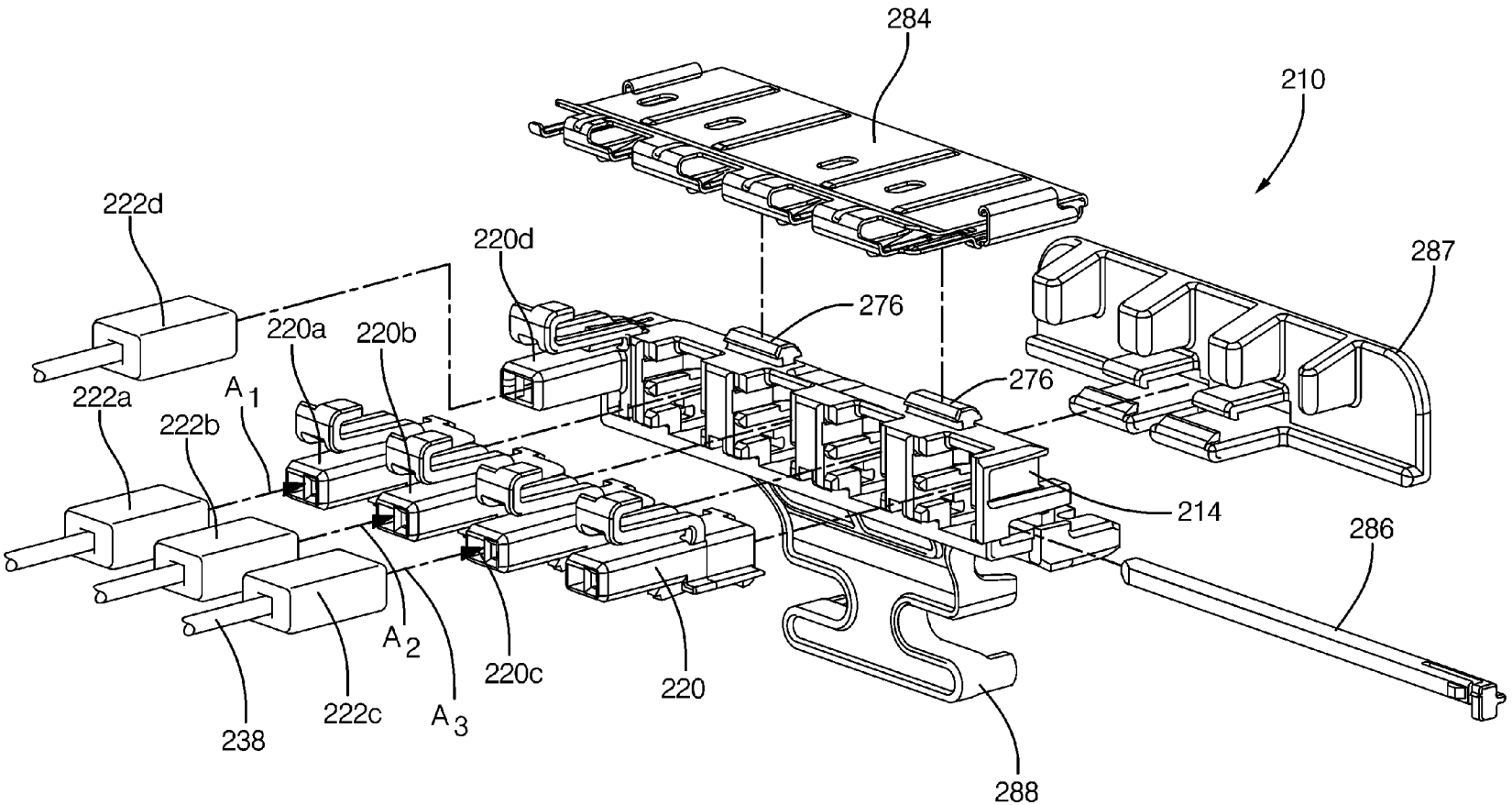
FIG. 1 shows an exploded view of an electrical connection system according to an embodiment of the invention.
Figure 2:
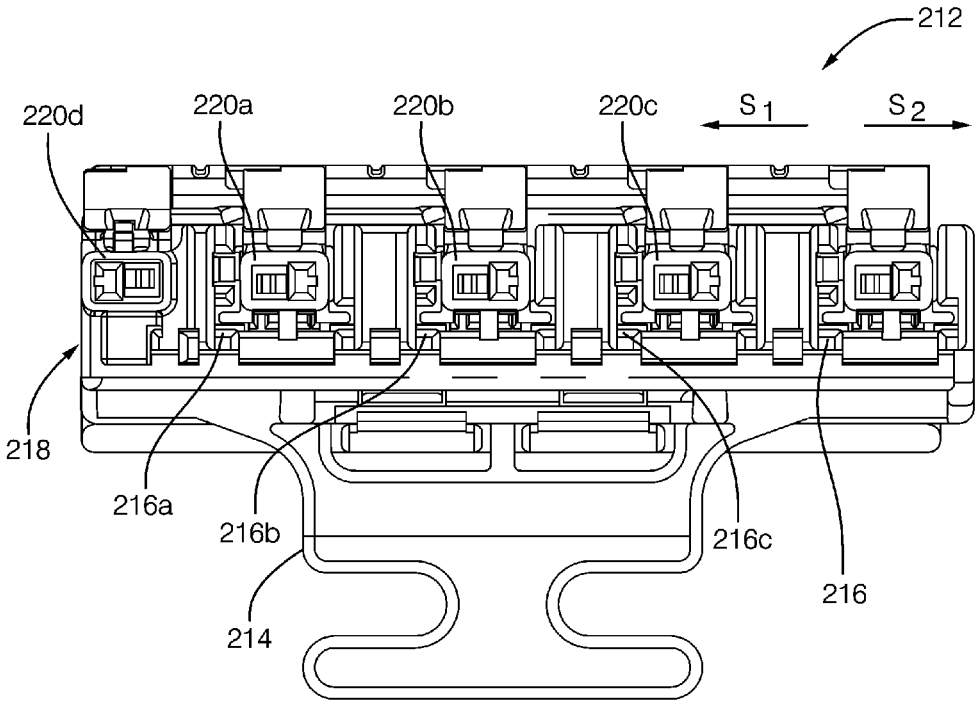
FIG. 2 shows a rear-side view of an arrangement of the electrical connection system of FIG. 1, and details thereof.

Referring to FIGS. 1-20, a ganged electrical connection system 210 is formed along a mating axis A that includes mating axes A1, A2, A3 and absorbs positional mating tolerance in an X- and a Y- and an axial, or Z-axis direction. Referring to FIGS. 1 and 2, system 210 includes an arrangement 212, a plurality of first or female connector housings or bodies, or female connectors 220, and a plurality of second, or male connector housings or bodies, or connectors 222. Arrangement 212 includes a support frame 214 where female connectors 220*a-c* are receivably coupled in a plurality of receptacles 216*a-c* defined in support frame 214. Wire conductors 236 are respectively attached to coupled female connectors 220. Male connectors 222 mate to coupled female connectors 220 of support frame 214 along a mating axes A1, A2, A3. Wire conductors 238 are respectively attached to terminals (not shown) that are respectively disposed in male connectors 222. A plurality of floating electrical connection systems for a ganged electrical connection system are described in U.S. non-provisional application U.S. Ser. No. 13/113,286 entitled "ELECTRICAL CONNECTION SYSTEM THAT ABSORBS MULTI-CONNECTOR POSITIONAL MATING TOLERANCE VARIATION," and is further incorporated by reference herein.

Figure 11:
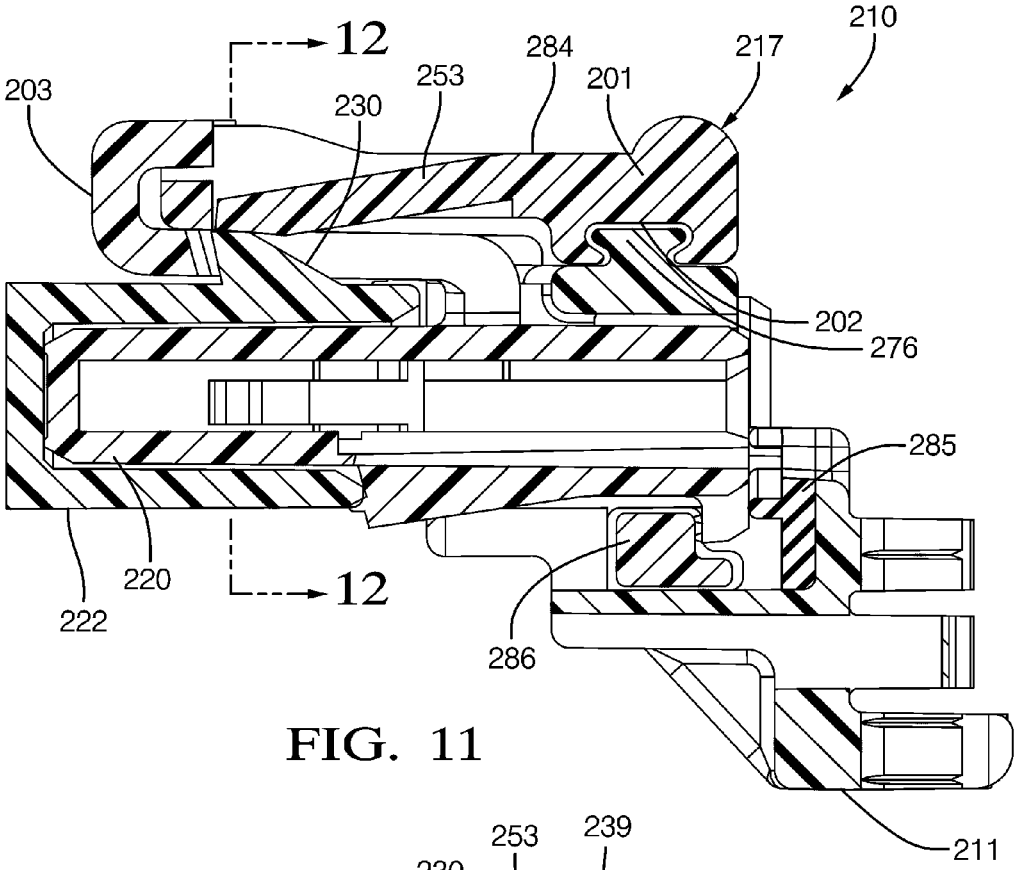
FIG. 11 shows a cross section view of the electrical connection system of FIG. 5 with the CPA member being disposed in a pre-stage position and the male connector received into the coupled female connector.

Referring to FIG. 11, arrangement 212 further includes a spring 285 formed of a dielectric material. Preferably, resilient spring 285 is constructed from a TPE or silicone material. One such dielectric spring that absorbs axial positional mating tolerance variation for multiple connectors is described in non-provisional application U.S. Ser. No. 13/113,313 entitled "ELECTRICAL CONNECTION SYSTEM HAVING DIELECTRIC SPRING TO ABSORB AXIAL POSITIONAL MATING TOLERANCE VARIATION FOR MULTIPLE CONNECTORS," and is further incorporated by reference herein. Plurality of receptacles 216 are formed in support frame 214 to constitute a row 218 that is generally perpendicular to mating axes A1, A2, A3. Spring 285 is disposed on support frame 214 to have an adjacent, parallel relationship with plurality of receptacles 216 in row 218.

Referring to FIGS. 1, 5-7, and 9-18, arrangement 212 further includes a connector position assurance (CPA) lock 284, a retainer pin 286, a wire conductor retainer 287, and a retention tail 288. The components that make up arrangement 212 as listed above including support frame 214 and connectors 220, 222 are preferably formed using durable non-electrically conducting dielectric materials, such as nylon, polyester plastic material, and the like. Alternately, different fillers may be added to strengthen the dielectric material as required by a specific electrical application. Using non-electrically conducting materials ensure system 210 will not electrically conduct an electrical short whether one should one occur inside or outside of system 210. This provides further safety during the handling of electrical connection system 210, such as when system 210 is assembled, for example, in an electrical application in a vehicle or when being serviced by a service technician. Using a dielectric material to form support frame 214 is especially desirable when including integral fixed male connector 212*d* with support frame 214 as fixed male connector 212*d* may be injection molded when support frame 214 is molded. Connectors 220, 222 may also be formed by injection molding. Alternately, support frame 214 may be formed any material that may also include a metallic material. Still yet alternately, the fixed connector may be fastened to the support frame by any suitable manner, such as welding the fixed connector to the metal support frame. Fixed female connector 220*d* does not absorb axial positional mating tolerance variation, and hence, does not engage spring 285. Still yet alternately, arrangement 212 may further include an integrated lock arm that may be integral or fastened to the support frame and may secure tabs disposed on the respective male connecters when they are fully mated to the coupled female connectors. The terminals may be formed of any electrically conducting material, such as a metallic tin or brass alloy material. The wire conductors, or cables may be formed from a copper or aluminum alloy material.

Female connector 220*d* is fixedly attached to support frame 214 and preferably integrally molded to support frame 214 that may provide an alignment feature for the mating of the remaining connectors in system 210 if system 210 is mated to a single electrical device. CPA member 284 includes a groove (not shown) that is fitted to one or more rails 276 disposed on support frame 214 so CPA member 284 is movingly attached to support frame 214. CPA member 284 is disposed on support frame 214 adjacent receptacles 216 that are formed in support frame 214 in row 218. CPA member 284 communicates with mated connectors 220, 222 that enables CPA member to be moved to a position on support frame 214 and ensure mated connectors 220, 222 do not prematurely unmate. For example, a premature unmating may occur if an undesired force is applied along the mating axis that may accidentally unmate at least one of the plurality of second connectors from at least one of the plurality of first connectors when it is desired that unmating not occur. A premature unmating of the connectors in the electrical connection system may cause the electrical devices connected to the electrical connection system to become undesirably inoperative. CPA member 284 may be constructed of a durable material being formed of a metal material or a dielectric material similar to that of support frame 214, as previously discussed herein.

In contrast, connectors 220, 222 are fully, or completely mated together when the terminals of the connectors 220, 222 are mated together so that electrical connections are realized within electrical connection system 210. Additionally, connectors 220, 222 are fully engaged when ramp (not shown) of male connectors 222 are engaged with lock arms 203 of coupled female connectors 220. Connectors 220, 222 are further fully mated when CPA member 284 is positioned on support frame 214 to ensure fully mated connectors 220, 222 do not unmate.

Figure 7:
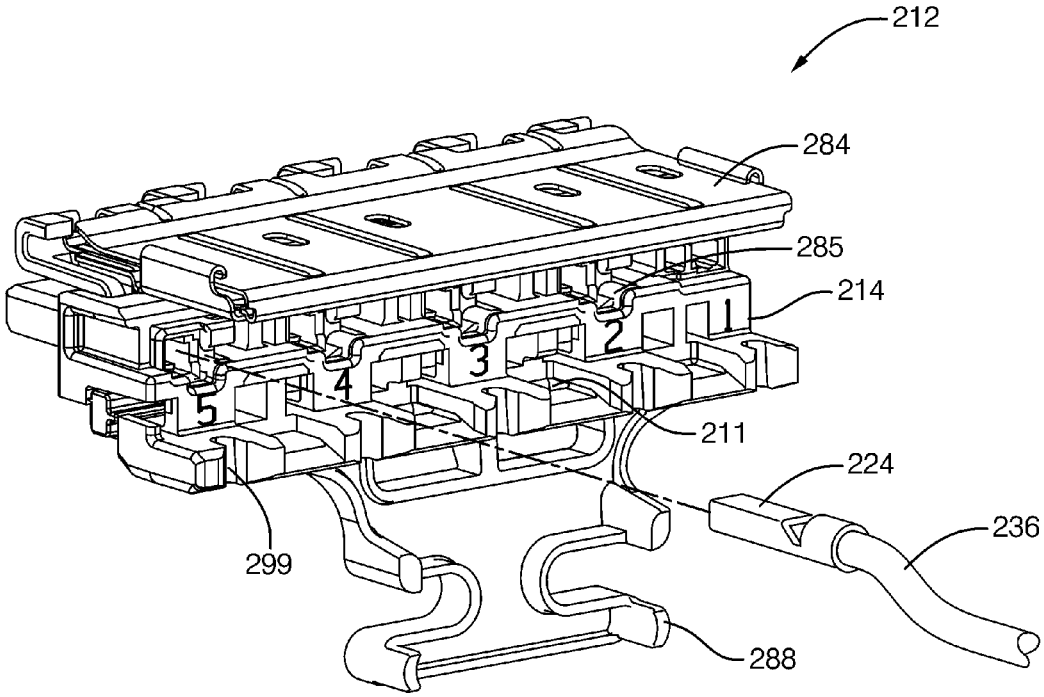
FIG. 7 shows a frontal view of the arrangement of FIG. 2, showing insertion of female terminals into the coupled first connectors.

Coupled female connectors 220*a-c* are additionally attached and secured to support frame 214 using retainer pin 286. Wire conductor retainer 287 further secures wire conductors 236 that communicate with female connectors 220 while also assisting to limit undesired rocking movement motion of support frame 214 when electrical connection system 210 is assembled together in an electrical application. Rocking motion of the electrical connection system during assembly in the electrical circuit application may cause undesired damage to the electrical connection system. Referring to FIG. 7, terminal 224 is electrically connected to wire conductor 236 that attach with other electrical components or systems.

Figure 3:
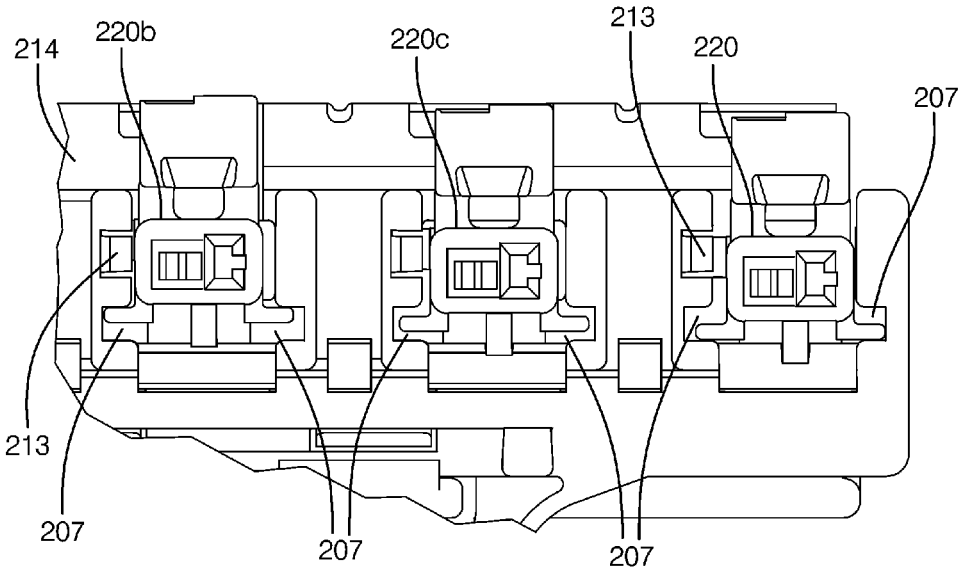
FIG. 3 shows possible float positions of the coupled first connectors in a support frame when mated with second connectors in the electrical connection system of FIG. 2.

Referring to FIG. 3, when receivably coupled in support frame 214, female connectors 220 including female connectors 220*a-c* movingly float about each receptacle in plurality of receptacles 216*a-c* in an X-axis, a Y-axis, and Z-axis direction in relation to each receptacle. Plurality of receptacles 216*a-c* absorb predetermined positional mating tolerance variation of male connectors 222*a-c* in relation to coupled female connectors 220*a-c* in an X-axis, Y-axis, and Z-axis direction about each receptacle in relation to each receptacle in plurality of receptacles 216*a-c*. The X-axis and the Y-axis direction are orthogonal to each respective mating axes $A_1$, $A_2$, $A_3$ for each receptacle in plurality of receptacles 216*a-c*. The Z-axis direction for each receptacle in plurality of receptacles 216*a-c* is co-axial with each mating axes $A_1$, $A_2$, $A_3$. Spring 285 may absorb any amount of predetermined positional mating tolerance variation in the Z-axis direction manifested at each receptacle 216*a-c* when connectors 220, 222 are mated. Retention tail 288 is provides an additional wire routing mechanism for routing of wire conductors 236 when arrangement 212 is employed an electrical circuit application. Retention tail 288 also provides an aid for a human assembler or service technician to handle support frame 214 during assembly of arrangement 212 in an electrical circuit application.

Retainer pin 286 is used to further secure female connectors 220*a-c* to support frame 214. Retainer pin 286 has a length $L_3$ and includes an index rib 289, a pin retention feature 290, and a crush rib 291. Retainer pin 286 is insertable in a cavity 292 formed in support frame 214 that communicates with retention feet 293 on each of plurality of coupled female connectors 220*a-c*. Index rib 289 is disposed along a length $L_3$ of retainer pin 286 and is used to ensure retainer pin 286 is inserted in support frame 214 in a single orientation. Retainer pin 286 fits along length $L_1$ of support frame 214 to communicate with receptacles 218*a-c*. Length $L_1$ of support frame 214 is greater than length $L_3$ of retainer pin 286. Crush rib 291 is useful to force retainer pin 286 after insertion in cavity 292 in an opposing direction away from crush rib 291 against a portion of support frame 214 in cavity 292 to ensure a tight retention fit for female connectors 220*a-c* and eliminate the potential for female connectors 220*a-c* to have undesirable rattle noise when employed in the electrical configuration. For instance, this feature may be very important to prevent rattle when the electrical connection system is employed in a vehicle electrical circuit application.

Figure 8:
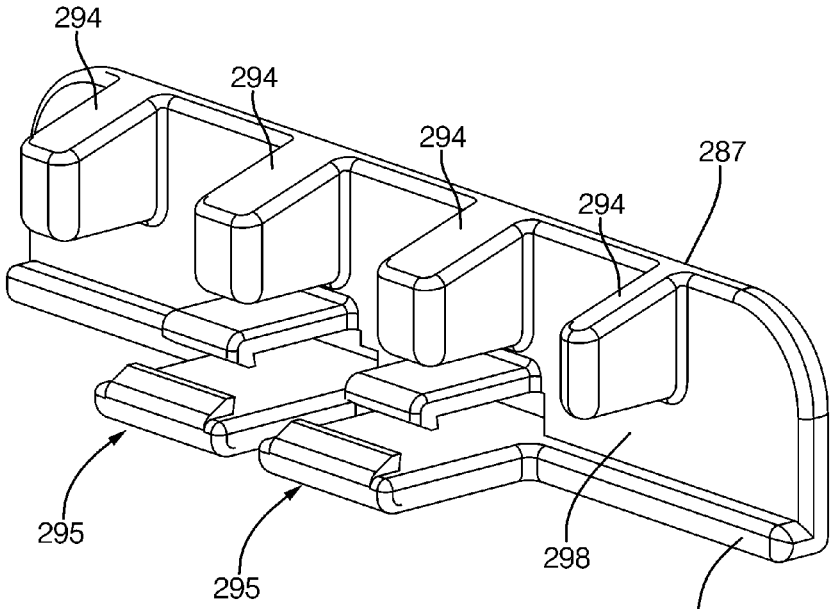
FIG. 8 shows a rear-side, left-hand view of a wire retainer for the arrangement of FIG. 7.

Referring to FIG. 8, wire conductor retainer 287 includes push pads 294, opposing locks 295, wire conductor retaining rail 296, a front face 297, and a rear face 298 opposing front face 297. Push pads 294 and locks 295 extend from rear face 298. Wire conductor retainer 287 is attached to support frame 214 so that push pads 294 abut support frame 214 and fit in a space in-between each receptacle in plurality of receptacles 216*a-c* to assist to limit undesired rocking motion of electrical connection system 210, as previously described herein. Opposing locks 295 communicate and connect with openings 209 in a clam shell-type manner to secure retainer 287 in support frame 214. When retainer 287 is attached to support frame 214, front face 297 serves as a push pad to stabilize and maneuver support frame 214 and female connectors 220 to mate with male connectors 222. Referring to FIG. 7, terminals 224 are inserted and fitted into forward section cavity 240*c* of female terminals 220 to reside in forward and rearward sections 272, 273 of cavities 240*a*, 240*c*. When wire retainer 287 is attached to support frame 214 using opposing locks 295, rail 296 abuts frame wire slots 299 to retain wire conductors 236 in frame wire slots 299. Retainer 287 assists to stabilize arrangement 212 and prevent undesired rocking motion to arrangement 212 during assembly of arrangement 212 in an electrical circuit application. Retainer 287 also assists to ensure a smooth mating connection of connectors 220, 222 especially when mating arrangement 212 with a single electrical device employing multiple connector connections.

Figure 4:
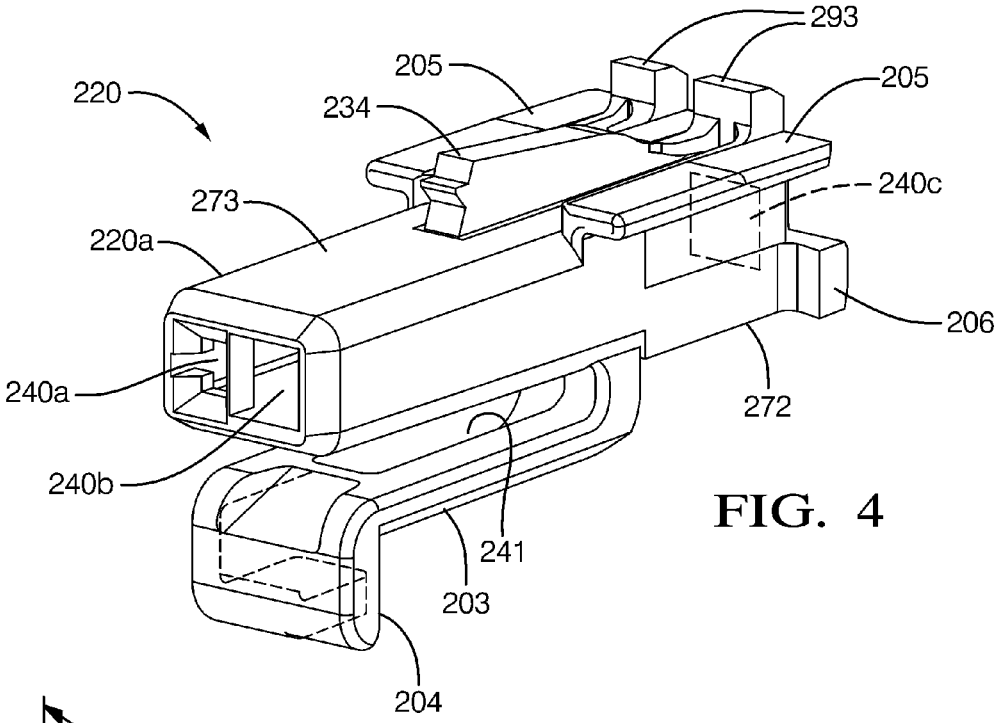
FIG. 4 shows a right-hand perspective view of a first connector of the electrical connection system of FIG. 1.
Figure 5:
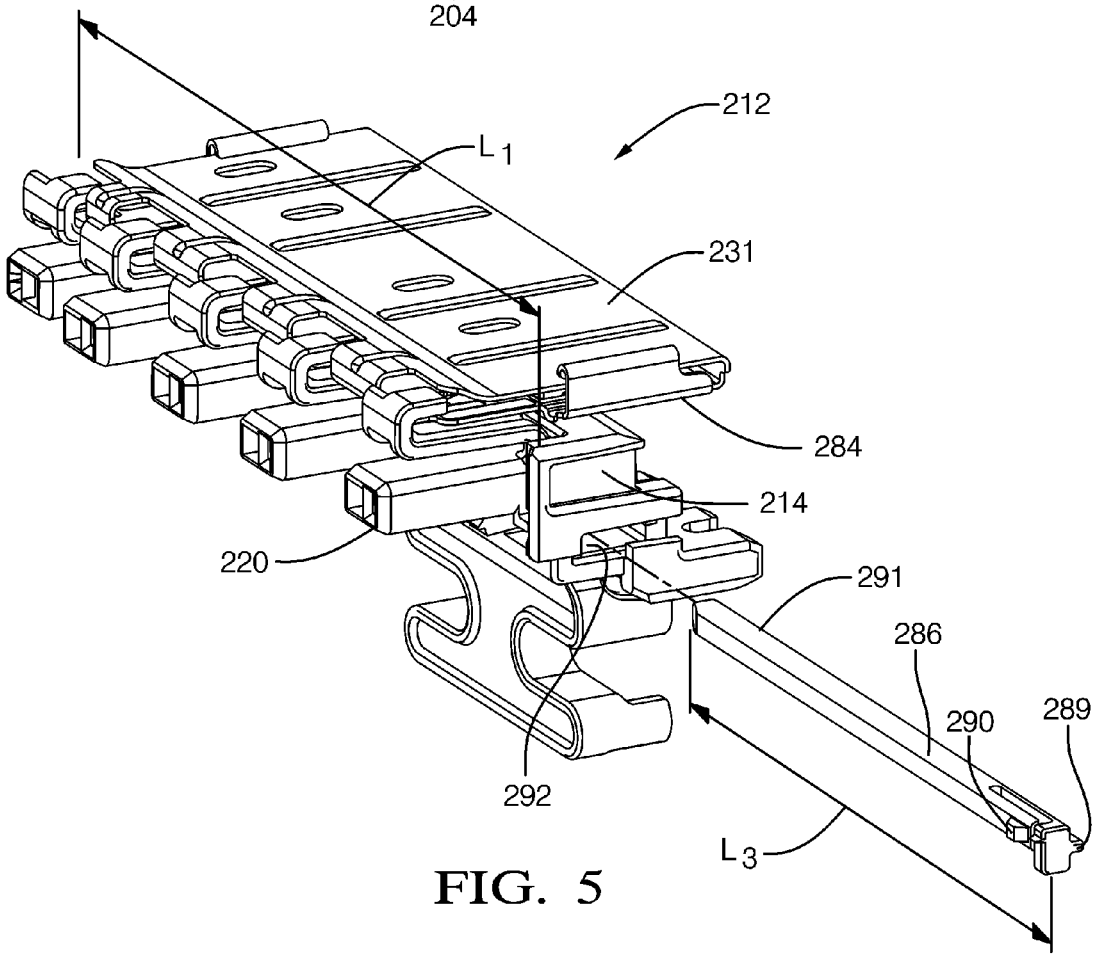
FIG. 5 shows the arrangement of FIG. 2 with a retainer being inserted into a support frame of the arrangement.
Figure 6:
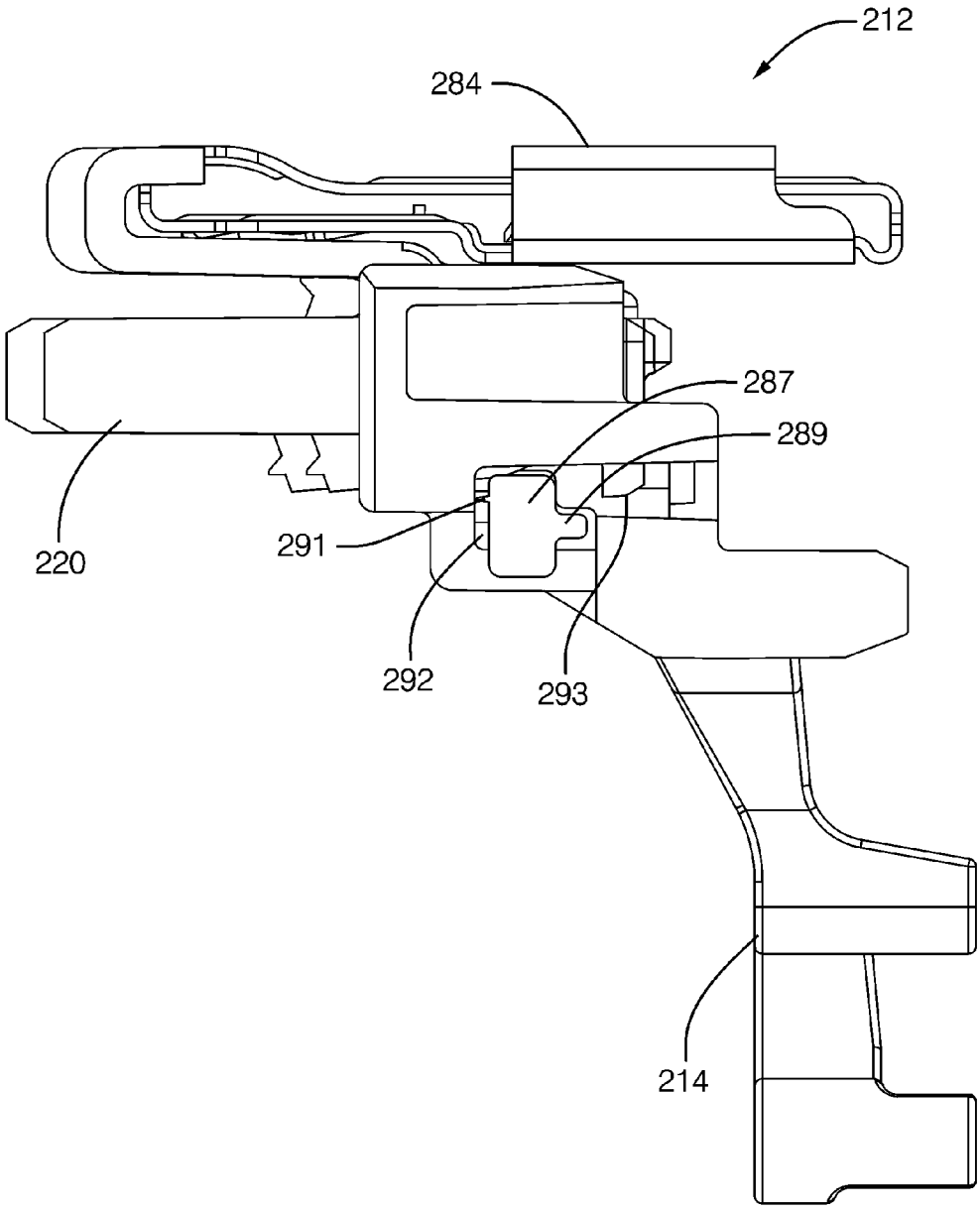
FIG. 6 shows a side view of the arrangement of FIG. 5, showing details thereof.

Referring to FIG. 4, female connector 220*a* includes forward section 272 and rearward section 273. Forward section 272 and rearward section 273 are generally axially aligned and not laterally offset when connectors 220*a*, 222*a* are mated. Forward section 272 of coupled female connectors 220*a-c* are configured to engage engagement portion 217 so spring 285 absorbs axial positional mating tolerance variation when male connectors 220 mate to female connectors 222. Rearward section 273 of female connectors 220 receivingly attach with male connectors 222 when connectors 220, 222 are mated. Fixed connector 220*d* receives male connector 222, but being fixedly attached in support frame 214, does not engage spring 285. Arrangement 212 is constructed to have little or no clearance between face 225 of female connectors 220 and spring 285, even when factoring in the manufacturing tolerances to construct support frame 214 and female connectors 220. When female connectors 220*a-c* are coupled in receptacles 216, however, there may be some residual clearance, or gap between face 225 of female connector 220*a-c* and spring 285 in one or more of receptacles 216. As male connectors 220 are not yet mated to female connectors 220, there will be marginal or no compression force of face 225 of female connectors 220 against spring 285. Faces 225 of coupled female connectors 220 will engage spring 285 when a sufficient amount of axial positional mating tolerance variation is manifested at receptacles 216 to so that a compression force of coupled female connectors 220 engages faces 225 against spring 285 when connectors 220, 222 are fully mated. Female connector 220*a* includes a primary terminal lock (not shown) and a secondary terminal lock 234, as previously described herein. Female connectors 220 are indexed with receptacles 216 as connector rails 205 fit with slots 207 in a single orientation. A lock arm 203 is formed in a general U-shape and extends from an exterior surface of female connector 220*a* on an opposite side of female connector 220 from integrated secondary lock (ISL) lock 234. The ISL is a secondary terminal lock that assists to secure terminal 224 in cavity 240*c*. Alternately, the ISL may be located at any location on the female connector. Lock arm 203 includes an elongate hole 241 therethrough having a width and a length sufficient to receive an inclined ramp 230 of male connector 222 when male connector 222 is received by rearward section 273. When inclined ramp 230 is received in elongate hole 241, male connecter 222 is fully mated with female connector 220. A portion of lock arm 203 includes a face 204 disposed distally on lock arm 203 from the exterior surface of female connector 220*a*. Face 204 is adapted to oppose a protrusion wall 255 of CPA member 284 to prevent male connector 222*a* from prematurely unmating from female connector 220*a*. Female connector 220*a* also includes retention feet 293 that communicate with retainer pin 286, as previously discussed herein. Two laterally-disposed connector rails 205 on female connector 220*a* are axially inserted in two corresponding axial slots 207 in receptacles 216 when female connectors 220 are receivably coupled in receptacles 216. When female connectors 220*a-c* are receivably coupled in receptacles 216, shoulders 206 urge against flexible lock 203 so as to deflect flexible lock 208 until shoulders 206 move past flexible lock 203 and flexible lock deflects back to a position so as to lock and seat female terminal 220 in receptacle 216. A flexible connector lock 213 retains female connectors 220*a-c* in receptacles 216. Connector rails 205 and slots 207 are suitably and sufficiently sized based on the predetermined positional mating tolerance variation that needs to be absorbed by receptacles 216. While coupled female connectors 220*a-c* have floatable movement about slots 207. Female terminal 220*b* is shown positioned in slots 207 in a top/left position, female terminal 220*c* is shown positioned in slots 207 in a central position, and female terminal 220 on the left portion of FIG. 3 is shown positioned in slots 207 in a bottom/right position. Flexible terminal locks (not shown) lock in female terminals 224 in female connectors 220 so terminals 224 remain secured in female connectors 220.

When arrangement 212 is ready for assembly in an electrical circuit application retaining pin 286 is inserted in cavity 292 after female connectors 220 are received in slots 207 of support frame 214. Wire conductor retainer 287 is also installed preferably have connectors 220, 222 have been mated and wire conductors 236 dressed.

Figure 9:
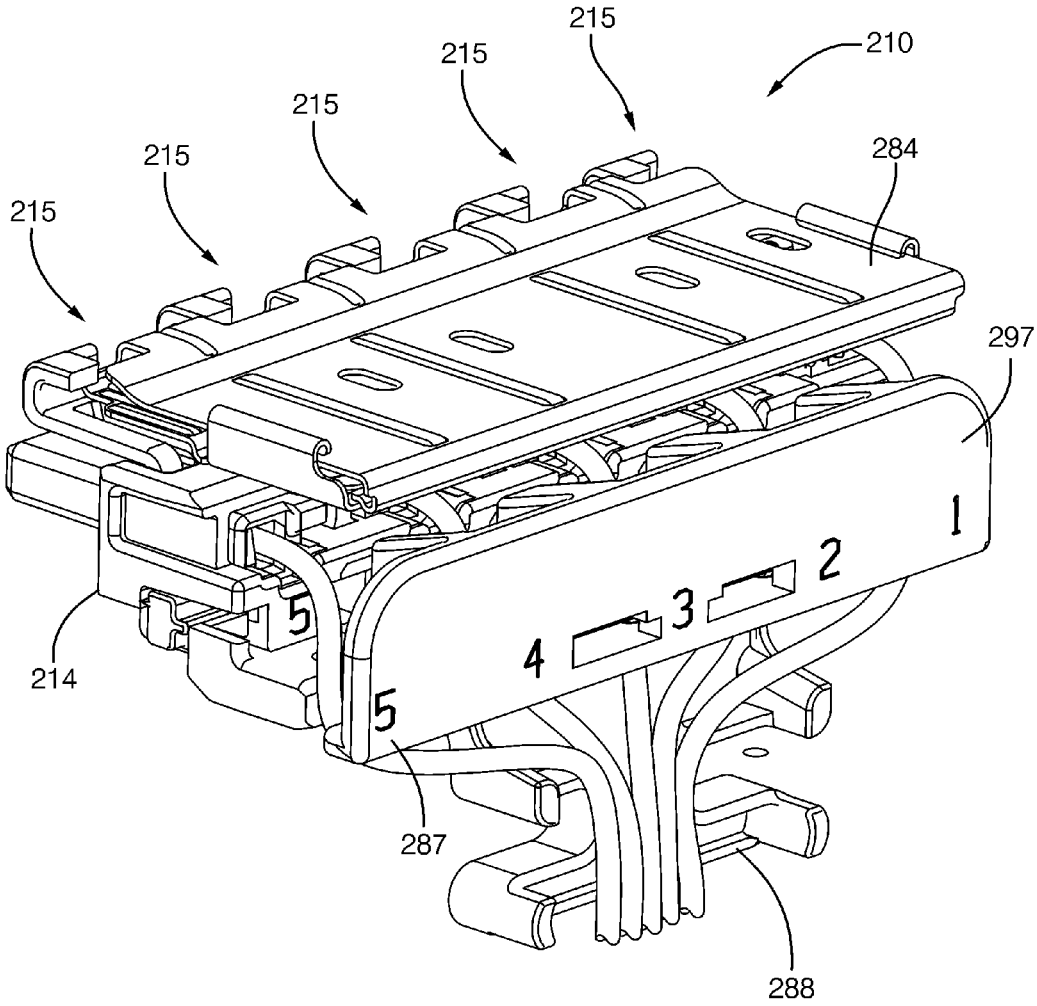
FIG. 9 shows the wire retainer of FIG. 8 attached to the arrangement of FIG. 7.
Figure 10:
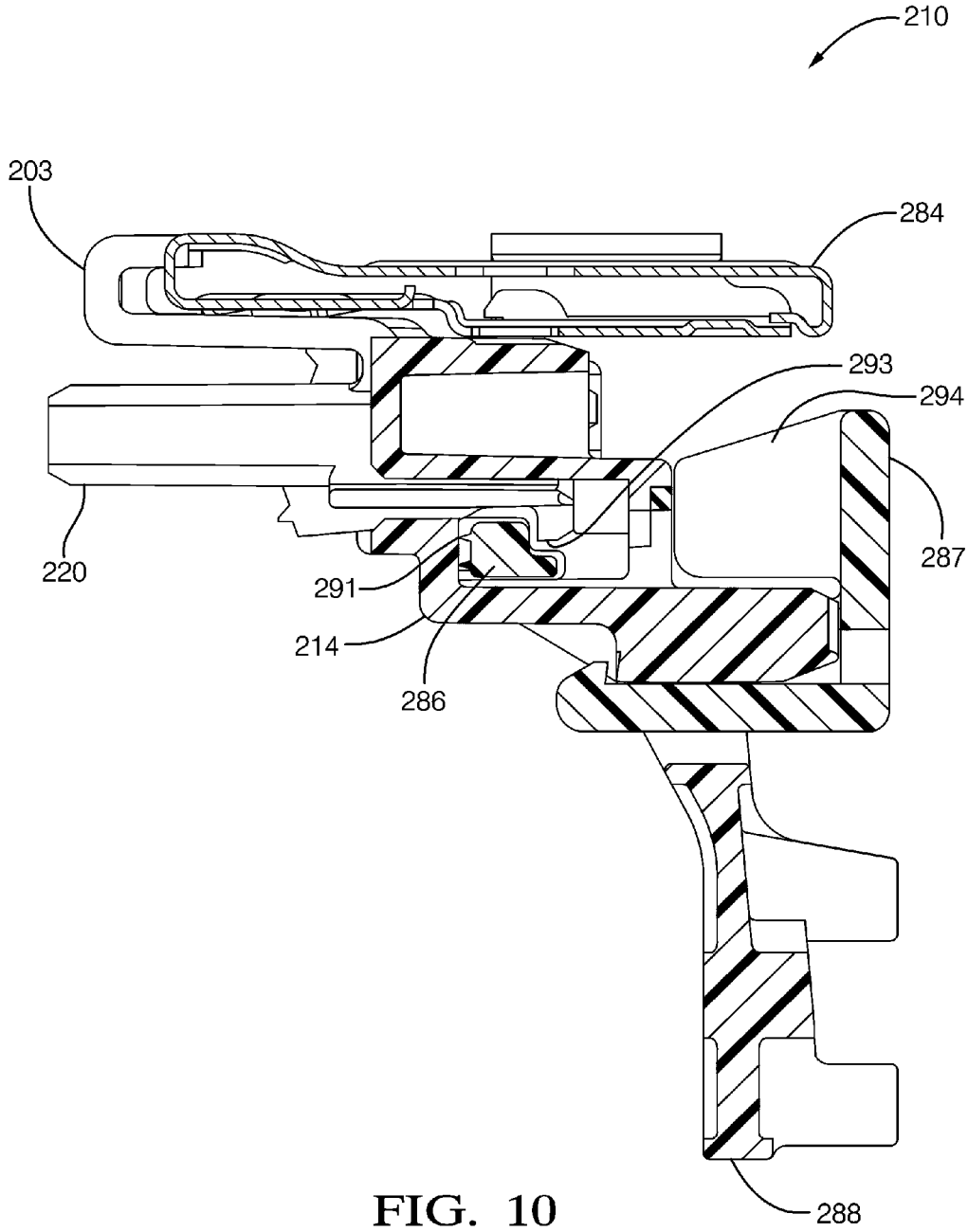
FIG. 10 shows a cross section view of the arrangement of FIG. 9, showing details thereof.

Turning our attention more particularly to the CPA member 284, referring to FIG. 11, generally planer CPA member 284 is formed of a single contiguous piece of material. CPA member 284 is constructed of a durable material as previously described herein. CPA member 284 has about a similar length as length $L_1$ of support frame 214. CPA member 284 includes a base 201. Base 201 includes groove 202 that is defined in base 201 disposed adjacent to support frame 214. Groove 202 is defined along the entire length of CPA member 284. Support frame 214 includes one or more rails 276 extending out from support frame 214 that overlie receptacles 216. Referring to FIG. 11, a single rail 276 is employed. Referring to FIG. 1, two distinct rails 276 are illustrated. Alternately, any number of laterally aligned rails may be employed to fit CPA member on to the support frame. Rails 276 have an ovular, double anvil-type shape. Groove 202 has a correspondingly similar shape that is somewhat larger than rails 276 so rails 276 may receive groove 202. When rails 276 receive groove 202, CPA member 284 is attachable to, and has slideable movement upon support frame 214 along the length $L_1$ of support frame 214. CPA member 234 includes a plurality of extended sections 215, as best illustrated in FIG. 9. When CPA member 284 is attached on rails 276, extended sections 215 extend axially outwardly away from base 201 of CPA member 284 to overlie receptacles 216 of support frame 214. Extended sections 215 communicate with coupled first connectors 220 and second connectors 222 mated to coupled first connectors 220 for each receptacle 216 to allow movable operation of CPA member 284 so that CPA member 284 may be configured in a position that prevents fully mated coupled first and second connectors 220, 222 from unmating.

CPA member 284 is a staged, bi-directional staged CPA member 284. CPA member 284 may be disposed in a pre-stage position 217 or a final stage position 226 remotely distanced along a length $L_1$ of support member 214 from pre-stage position 217. Base 201 further defines a pair of notches, or cutouts 231*a*, 231*b* along a raised wall 265 of support frame 214. Raised wall 265 generally extends along the length $L_1$ of support frame. Cutout 231*a* is spaced apart from cutout 231*b* along support frame 234 in a direction perpendicular to mating axes $A_1$, $A_2$, $A_3$. CPA member 284 contains a detent 235 that fits in cutout 231*a* when CPA member 284 is disposed in pre-stage position 217. Detent 235 also fits in cutout 231*b* when CPA member 284 is disposed in final stage position 226*b*. After initial assembly of CPA member 284 atop support frame 214, CPA member 284 is disposed in pre-stage position 217 where detent 235 is disposed in cutout 231*a*. CPA member 284 is prevented from further movement past pre-stage position 217 to final stage position 226 after initial assembly of CPA member 234 to support frame 234 as resilient release fingers 253 of CPA member 234 are disposed in elongate holes 241 of respective lock arms 203 of female connectors 220.

After initial assembly of CPA member 284 on support frame 214, CPA member 284 is configured for movement between pre-stage position 217 and final stage position 226 in respective directions $s_1$, $s_2$ in relation to the fully mated connectors 220, 222. The direction of $s_1$ is opposite of the direction of $s_2$. CPA member 284 is configured for movement from pre-stage position 217 to final stage position 226 along first direction $s_1$. Once in final stage position 226, raised wall 265 prevents further movement of detent 235 along first direction $s_1$ past final stage position 226 as detent 235 will engage raised wall 265. CPA member 284 is also further configured for movement from final stage position 226 back to pre-stage position 226 in second direction $s_2$ opposite first direction $s_1$. Consequently, directions $s_1$, $s_2$ are bi-directional movement directions for CPA member 284 and these movement directions are generally perpendicular to mating axes $A_1$, $A_2$, $A_3$ when CPA member 284 is assembled on support frame 214. However, CPA member 284 is not freely moveable between pre-stage position 217 and final stage position 226. The conditions for movement of CPA member 284 between stages 217, 226 will be further described below. Only if CPA member 284 is disposed in final stage position 226, under normal operation, will CPA member 284 be properly positioned on support frame 214 to prevent male connectors 222 from freely unmating from female connectors 220 in an unrestricted fashion. Only if CPA member 284 is disposed in pre-stage position 217 and male connectors 222 are fully mated with female connectors 220, will CPA member 284 be positioned and configured to potentially allow male connectors 222 to unmate from coupled female connectors 220. Even when CPA member 284 is positioned in pre-stage position 217 and the male connectors 222 are fully mated, a tool 237 is required to engage CPA member 284 through an aperture 239 in CPA member that receives an end of tool 237 so that tool 237 may be used as a lever to apply a sufficient force to deflect CPA member 284, which subsequently deflects lock arms 203 of female connectors 220 in a manner that allows inclined ramps 230 disposed in elongate holes 241 to be removed, or untrapped from elongate holes 241 allowing mated male connectors 222 to be unmatable from coupled female connectors 220 in support frame 214. For example, tool 237 may be a flat-bladed screwdriver. Alternately, the tool may be any tool that fits the aperture to be used as a lever to engage the CPA member. Alternately, any tool that fits the aperture to allow a sufficient force to be applied against the tool to deflect the CPA member may be used.

Each of the coupled female connectors 220 and mated male connectors 222 communicate with CPA member 234, respectively, in a manner that enables CPA member 234 to move into final stage position 219 from pre-stage position 217, relative to the mated connectors 220, 222, such that when disposed in final stage position 219, CPA member 234 prevents connectors 220, 222 from unmating. CPA member 234 communicates respectively with connectors 220, 222 through plurality of extended sections 215. When CPA member is disposed in pre-stage position 217, an extended member 215 for each receptacle 216 generally overlies each receptacle 216.

To better simplify the discussion of the plurality of extended sections 215, a single extended section 215 will now be described. Referring to FIGS. 9, 13, 13A and 14 extended section 215 includes a first extending protrusion wall 255, a second extending protrusion wall 257, a release finger 253, and an L-shaped connecting tab 259. Release finger 253 is a resilient release finger that extends from base 201 in an angled, downward manner toward coupled female connector 220. Protrusion walls 255, 257 and release finger 253 also axially extend away from base 201 to overlie respective receptacles in the plurality of receptacles 216 when CPA member 284 is positioned in pre-stage position 217. First protrusion wall 255 extends farther away from base 201 than does second protrusion wall 257. Second protrusion wall 257 is disposed intermediate first protrusion wall 255 and release finger 253. Connecting tab 259 is attached to second protrusion wall 257 and a first protrusion wall 255 of the next adjacent extended section 215. Connecting tab 259 has a thickness that is sufficiently thin so that connecting tab 259 is received in U-shaped lock arm 203 of coupled first connector 220 when CPA member 284 is disposed in pre-stage position 217. Connecting tab 259 defines an opening, or aperture therethrough 239 where release finger 253 is disposed therein. First protrusion wall 255 for each extended section 215 is disposed closer to detent 235 of the CPA member in a direction perpendicular to the mating axes $A_1$, $A_2$, $A_3$ when CPA member 284 is disposed on support frame 214. First protrusion wall 255 is disposed closer to detent 235 than second protrusion wall 257, connecting tab 259 and release finger 253 for each respective extended section 215. When CPA member 284 is disposed in pre-stage position 217, release fingers 253 are in axial alignment with inclined ramps 230 of male connectors 222 when male connectors 222 are received in coupled female connectors 220.

Initial assembly of CPA member 284 to support frame 214 occurs by sliding CPA member 284 on rails 276 disposed on support frame 214 until detent 235 engages and is moved past a portion of raised wall 265 and disposed in cutout 231*a* disposing CPA member 234 in pre-stage position 217. CPA member 234 may be moved along support frame 214 in direction $s_1$ by applying pressure against CPA member 234, such as may occur by using an appendage of the human hand of a human operator. Female connectors 220 are then received in receptacles 216 so that release fingers 253 of CPA member 234 are received in elongate holes 241 of coupled first connectors 220 to further secure CPA member 284 in pre-stage position 217 and prevent further lateral movement of CPA member 284. Being locked in pre-stage position 217 keeps CPA member 234 from inadvertently being moved out of and away from pre-stage position 217 to final stage position 219 or being removed off from support frame 214. Each extended section 215 is similarly constructed and the plurality of extended members 215 is best illustrated in FIG. 9. Thus, when considering all of the extended members 215 as a group CPA member 234 contains a plurality of tabs 239 and a plurality of release fingers 253.

CPA member 284 is not in use if female connectors 220 are not coupled in any of the available receptacles 216 of support frame 214. Thus, receptacles 216 are void of female connectors 220. When female connectors 220 are coupled in the available receptacles 216 in support frame 214, and male connectors 222 have been fully mated to at least one, but not all of coupled female connectors 220, CPA member 284 is also not in use. When this scenario occurs, and the at least one female connector 220 has not received male connector 222, CPA member 284 is not moveable along support frame 214 as release finger 253 is disposed in aperture 239 of lock arm 203 of at least one of female connector 220. Consequently, it is important that the individual lock arms 203 are engaged by the respective male connectors 220 and release fingers 253 deflect as a result of engagement with inclined ramps 230 of the received male connectors 222. After this occurs, CPA member 284 is movable to final stage position 219 where CPA member 284 ensures all of the male connectors 222 mated with the coupled female connectors 220 remain mated.

Figure 12:
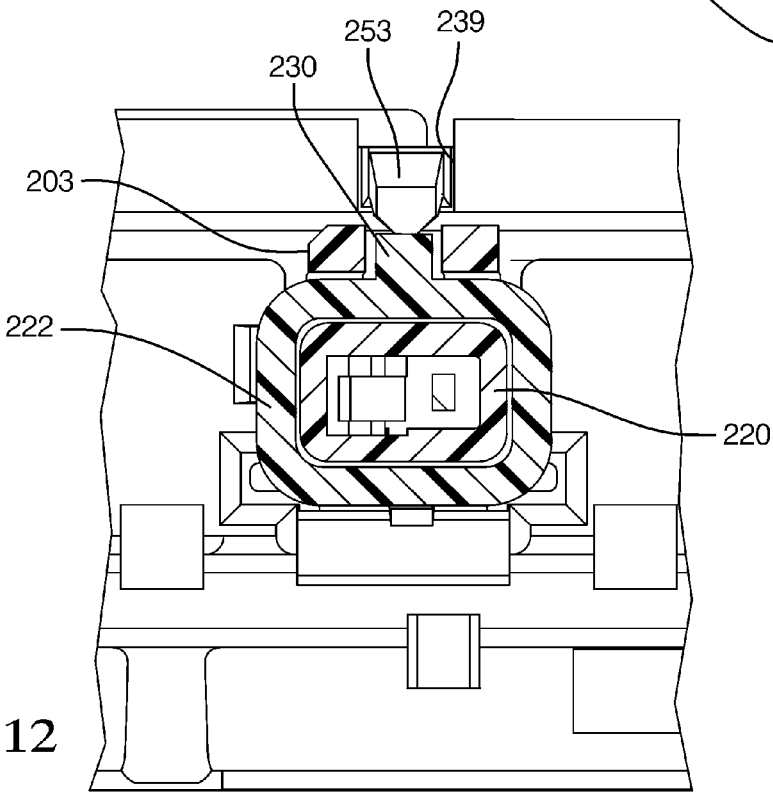
FIG. 12 shows a cross section view of the electrical connection system of FIG. 11 through the lines 12-12, and the release finger overlies the inclined ramp of the received male connector.
Figure 13:
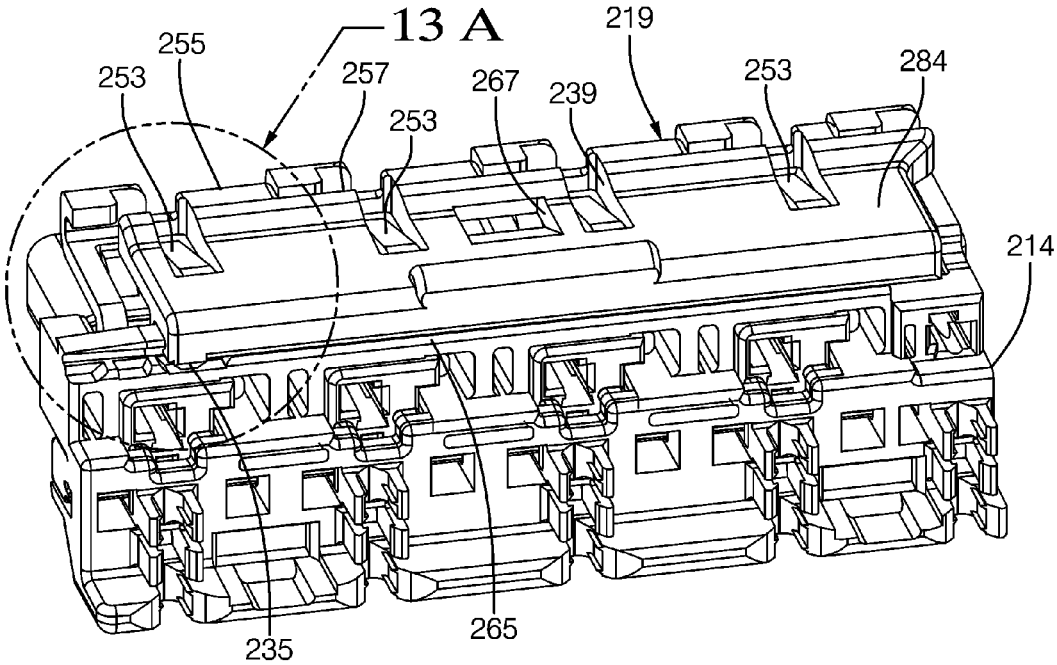
FIG. 13 shows the electrical connection system of FIG. 5 with the CPA member being disposed in a final stage position.
Figure 13A:
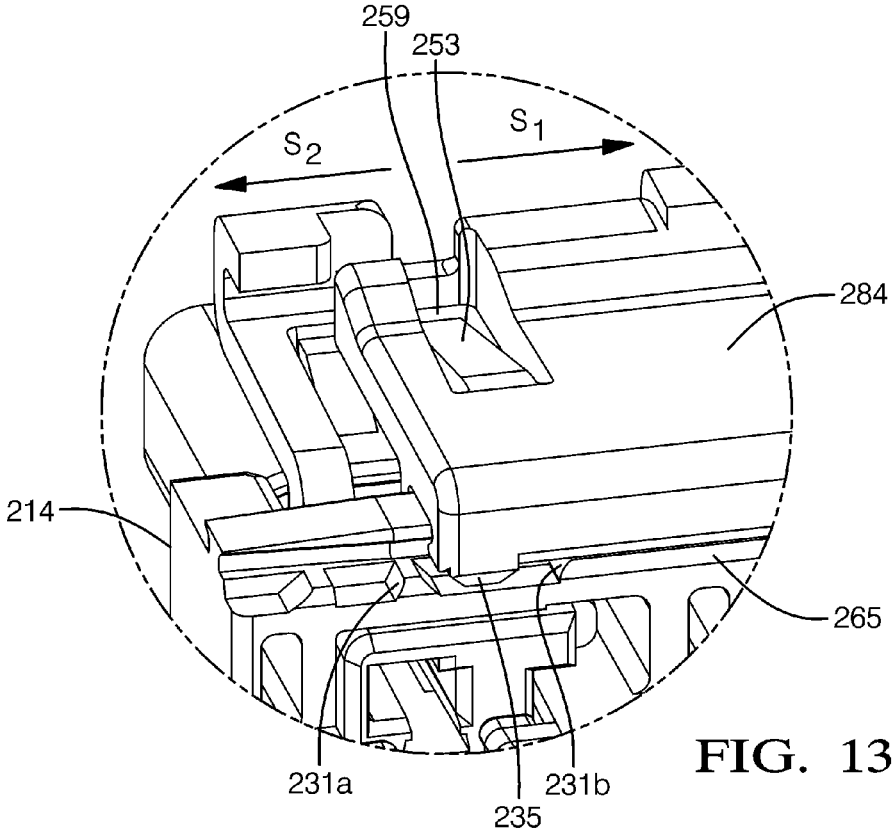
FIG. 13A shows a magnified view of the electrical connection system of FIG. 13, showing details thereof.
Figure 14:
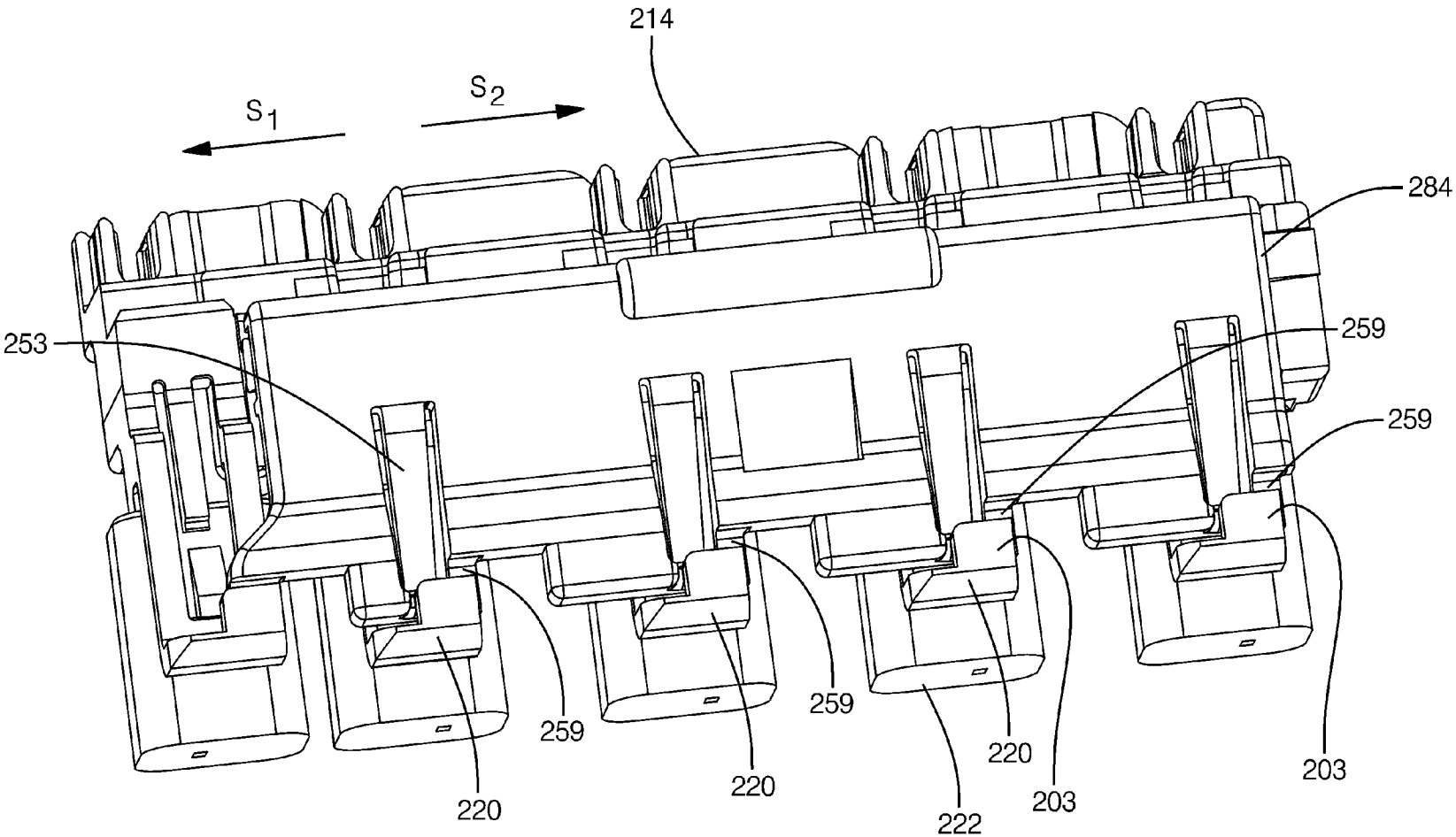
FIG. 14 shows a topical view of the electrical connection system of FIG. 11, showing connecting tab details thereof.
Figure 15:
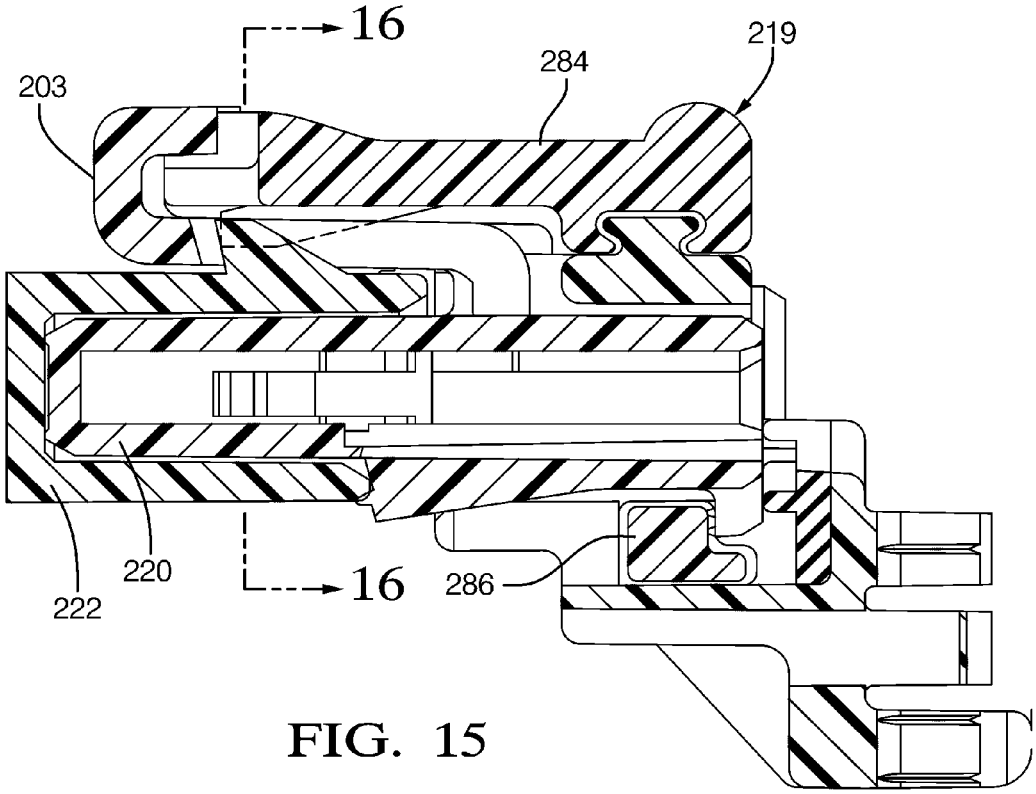
FIG. 15 shows a cross section view of the electrical connection system of FIG. 13, showing details thereof.
Figure 16:
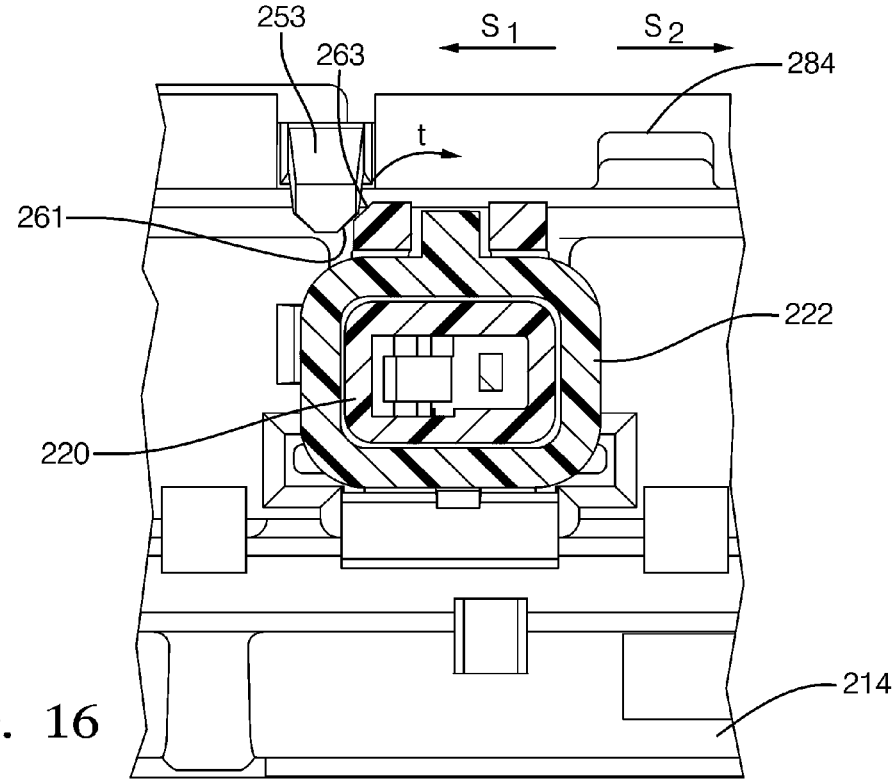
FIG. 16 shows a cross section view of the electrical connection system of FIG. 15 through the lines 16-16, showing extended section details thereof.
Figure 19:
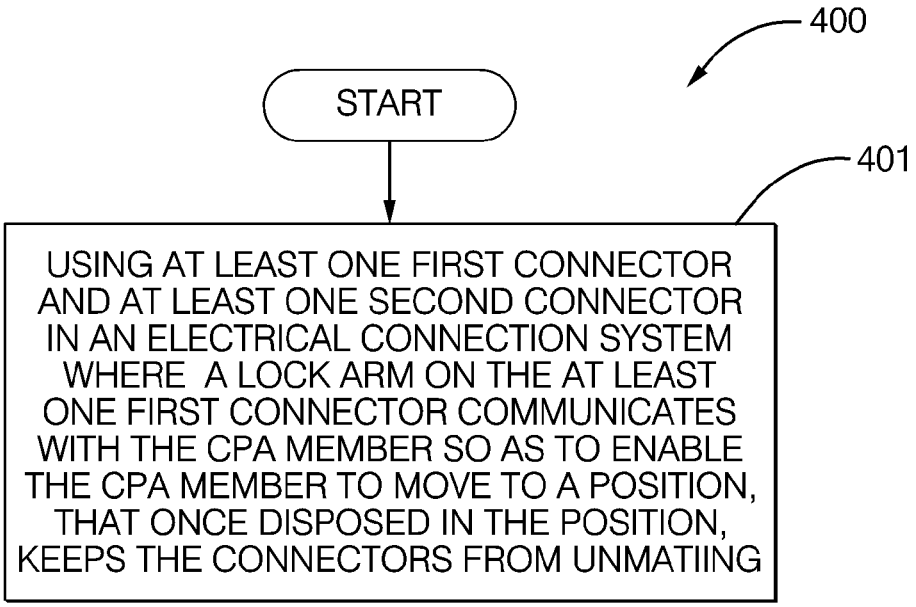
FIG. 19 shows a method of fabricating an electrical connection system of FIG. 5 that includes the CPA member.
Figure 20:
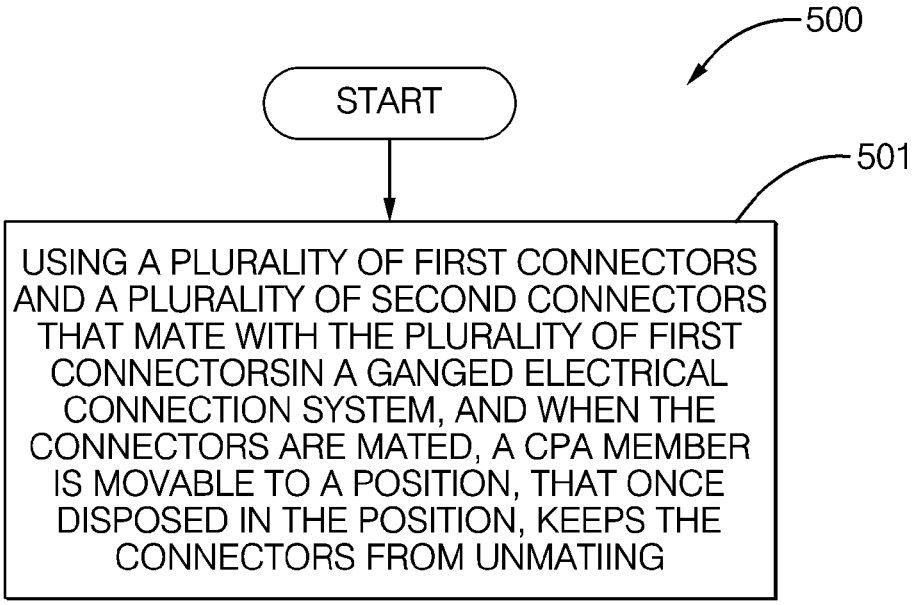
FIG. 20 shows a method of fabricating a ganged electrical connection system of FIG. 5 that includes the CPA member.

CPA member 284 is operatively in use when all female connectors 220 are coupled in all available receptacles 216 of support frame 214 and male connectors 222 are fully mated to these coupled female connectors 220. Faces 204 of first connectors 220 do not face protrusion walls 255, 257 of CPA member 284, rather faces 204 of CPA member 234 face towards aperture 239 that includes release fingers 253. When male connector 222 is mated with coupled female connector 220, inclined ramp 230 of male connector 222 engages release finger 253 so as to deflect release finger 253 an amount as determined by a height of inclined ramp 230, as best illustrated in FIGS. 11 and 12. As male connector 222 mates with coupled female connector 220, inclined ramp 230 also snap-fits into elongate hole 241 of lock arm 203 to secure male connector 222 in coupled female connector 220. Referring to FIG. 12, as the remaining male connectors 222 in system 210 are mated with the corresponding coupled female connectors 220, the remaining plurality of release fingers 253 are similarly deflected and inclined ramps 230 are similarly disposed in respective elongate holes 241 of the plurality of lock arms 203. When release fingers 253 are deflected so as to be removed from elongate holes 241, CPA member 284 is unimpeded so as to be moveable along support frame 214 in direction $s_1$ to final stage position 219 as all the release fingers 253 are disengaged from elongate holes 241 and are no longer restricted for lateral movement along a portion of length $L_1$ of support frame 214. Referring to FIGS. 15-16, CPA member 284 is disposed in the final stage position. When CPA member 284 is moved to final stage position 219, connecting tab 259 also laterally moves and no longer underlies U-shaped lock arm 203. Release finger 253 laterally moves and no longer overlies inclined ramp 230 of male connector 222. As release finger 253 moves past male connector 222 into a space along support frame 214 that is void of male connector 222 adjacent to another adjacent receptacle 216, release finger 253 drops into a neutral position where there is substantially no deflecting force applied against release finger 253, perhaps best illustrated in FIG. 16. A portion of U-shaped lock arm 203 is disposed adjacent an edge of an adjacent first protrusion wall 255 such that lock arm 203 engages first protrusion wall 255 and assists to prevent further movement of CPA member 284 past final stage position 219 in direction $s_1$. When CPA member 284 is in final stage position 219 and tool 237 is inserted in an opening 267 having a closed end so that a force applied by tool 237 deflects CPA member 284, CPA member 284 will not engage connecting tabs 259 against lock arms 203 as connecting tabs 259 are not disposed in lock arms 203 when CPA member 284 is in final stage position 219. Should an attempt be made to unmate male connector 222 when CPA member 284 is disposed in final stage position 219, the engagement of inclined ramp 230 in elongate hole 241 prevents male connector 222 from easily being unmated from coupled first connector 220. The remaining extending sections 215 are constructed in a similar fashion to the single extending section 215 previously described above. Referring to FIG. 19, this is step 401 in method 400 for an electrical connection system. Referring to FIG. 20, this is step 501 in method 500 for a ganged electrical connection system.

Figure 17:
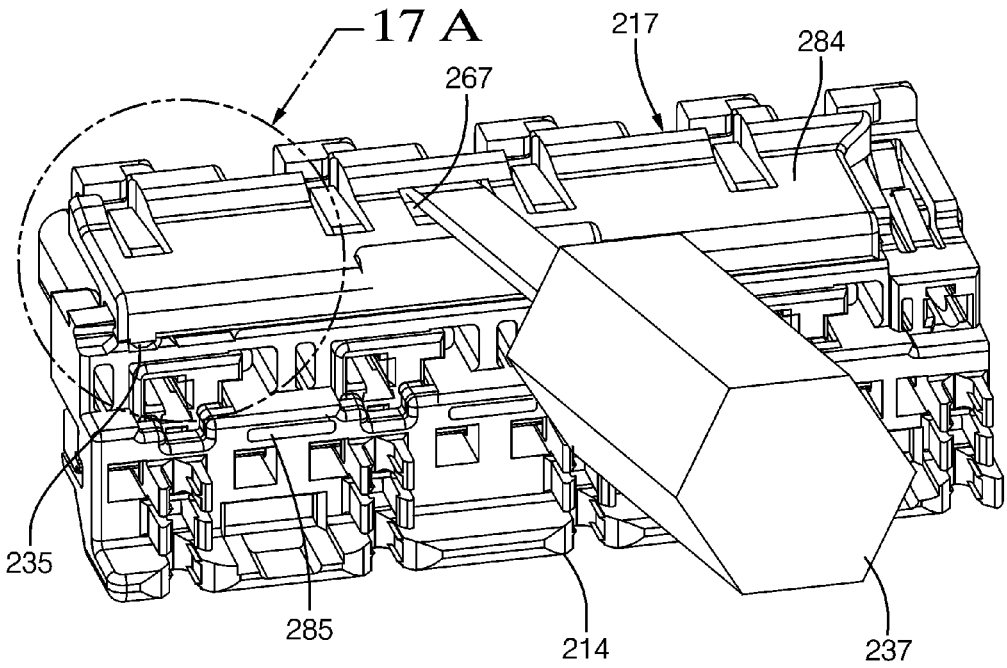
FIG. 17 shows the electrical connection system of FIG. 11, and a tool being inserted into an opening of the CPA member.
Figure 17A:
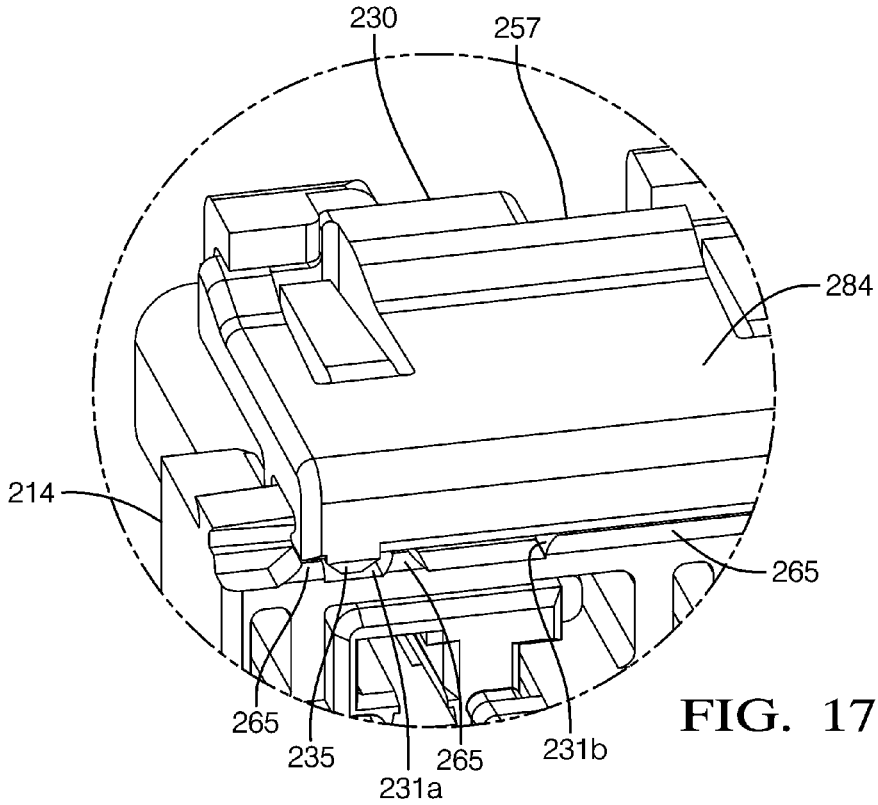
FIG. 17A shows a magnified view of a portion of the electrical connection system of FIG. 17.
Figure 18:
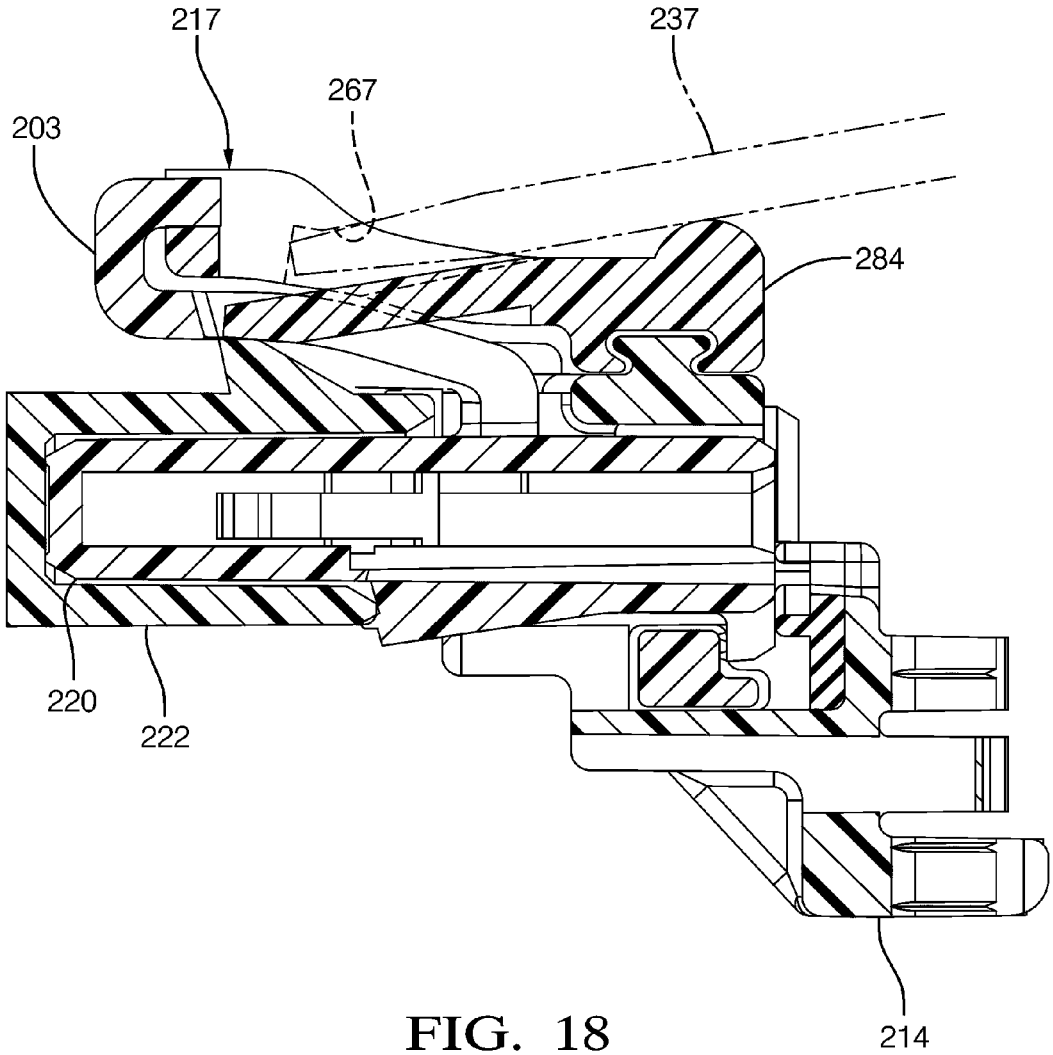
FIG. 18 shows the electrical connection system of FIG. 17, and a force being applied to the CPA member by the tool.

CPA member 234 of electrical connection system 210 is configured to advantageously allow a collective umating of male connectors 222 from coupled first connectors 220 at about a same period in time. In other words, the plurality of male connectors 222 may be unmatable as though the plurality of male connectors were a single male connector being unmated, as further discussed below. When male connectors 222 need to be unmated from coupled first connectors 220, CPA member 234 is manually moved by a human operator, such as a service technician or assembler, in direction $s_2$ back to pre-stage position 217. Once in pre-stage position 217, connecting tabs 259 again underlie U-shaped lock arms 203 of coupled female connectors 220. A sloped surface 261 along a portion of release finger 253 engages a sloped surface 263 along a portion of male connector 222 so that release finger 253 is urged to be positioned atop male connector 222 to again be disposed to overlie incline ramp 230 of male connector 222. When the frictional forces against the engaging sloped surfaces 261, 263 are overcome by the applied force to move the CPA member from final stage potion 219 to pre-stage position 217, sloped surfaces 261, 263 ensure release finger 253 moves in direction $s_2$ to overlie male connector 222 and come to rest to overlie inclined ramp 230 of male connector 222. Once in pre-stage position 217, referring to FIG. 17, tool 237 is inserted in opening 267 to engage CPA member 284. The human operator may use tool 237 as a lever to apply a force against CPA member 284 to outwardly deflect CPA member 284. As CPA member 284 deflects in a direction outwardly away from support frame 214, in response to the force applied by tool 237 connecting tabs 259 received in lock arms 203 engage lock arms 203 so that lock arms 203 deflect outwardly way from rearward section 273 of female connector, as best illustrated in FIG. 18. When lock arms 203 of coupled first connectors 220 deflect above a height of the respective incline ramps 230, male connecters 222 are able to be unmated from coupled first connectors 220. Male connectors 222 are unmatable as inclined ramps 230 no longer restrict, or inhibit movement of male connectors 222 away from coupled female connectors 220.

Alternately, instead of the CPA member being engaged with a tool to allow the plurality of second connectors to be unmatable with coupled female connectors as previously described herein, the CPA member may employ a pump handle. When a force is applied generally perpendicular to the pump handle the CPA member deflectingly engages the lock arms of the coupled female connectors when disposed in the pre-stage position.

In one particular alternate embodiment, the CPA member employs a pump handle 231 along a rear area of the CPA member opposite the extended portions. The plurality of rails disposed on the support frame are further cylindrical in shape in contrast to the anvil shape of rails 276 as illustrated in FIG. 1. These cylindrical rails fit a cylindrical slot of the CPA member. A slot disposed in the cylindrical rails accepts a rotation limiter on the CPA member such that the CPA member may be rotated when the force is applied to the pump handle when the CPA member is disposed in the pre-stage position. The rotation of the CPA member allows the CPA member to engage the lock arms of the coupled first connectors when the CPA member is disposed in the pre-stage position in a similar manner as CPA member 284 that is engaged with tool 237, as illustrated in FIG. 17. When the CPA member is employed in the final stage position, the rotation limiter will interfere with a mounted cylinder web of the cylindrical rails so that the CPA member will not have rotation when the force is applied to the pump handle of the CPA member.

In another alternate embodiment, a stop may be added to the retainer between the support frame and the CPA member or the wire retainer and the CPA member to eliminate activation of the CPA member when the CPA member is disposed in the final stage position. This would inhibit movement of the CPA member when the CPA member is disposed in the final stage position. Still yet alternately, this stop feature may be used in combination with other features of the CPA member's pump handle feature to further ensure that the CPA member is not movably activated in the final stage position.

Still yet alternately, if the number of coupled female connectors used in particular electrical configuration is less than the amount of receptacles, and the additional unused receptacles are left empty, or void of coupled female connectors, the movement operation and the function of the CPA member remains in use as described herein.

In yet another alternate embodiment, if any of the receptacles are populated with a coupled female connector, but any of the coupled female connectors are not mated with a corresponding male connector, the CPA member will not function.

Alternately, the rails of the CPA member may have any shape such that a corresponding shape of the groove of the CPA member allows the CPA member to be received by the rail and allow movement of CPA member along the support frame thereon between the pre-stage and the final stage position as described herein.

Alternately, the male connectors may be electrically connected to a plurality of battery cells that form a battery stack. The battery stack then is mated to the electrical connection system in a single, unimpeded movement. In another alternate embodiment, the battery cells may be associated with an electric vehicle, a hybrid electric vehicle, or a plug-in electric vehicle. Regardless of the intended application, the CPA member performs as described herein to keep the male connectors of battery stack from unmating from the coupled first connectors in the electrical connection system. Still yet alternately, the plurality of male connectors may be associated with a single electronic component or assembly that mates with the electrical connection system and the CPA member still performs in a manner as described herein.

Similar elements in the embodiment of FIGS. 1-18 herein are shown having the same reference numerals in the embodiment of FIGS. 13-22 of application U.S. Ser. No. 13/113,286 entitled "ELECTRICAL CONNECTION SYSTEM THAT ABSORBS MULTI-CONNECTOR POSITIONAL MATING TOLERANCE VARIATION." Additionally, first protrusion wall 255 as described herein is protrusion wall 233 of application U.S. Ser. No. 13/113,286 entitled "ELECTRICAL CONNECTION SYSTEM THAT ABSORBS MULTI-CONNECTOR POSITIONAL MATING TOLERANCE VARIATION."

Thus, an electrical connection system includes a CPA member that robustly, consistently, and repeatedly ensures connector devices remain mated regardless of the number of connector devices used in a configuration has been presented. The CPA member is conveniently secured to a support frame that may be constructed to include one or more receptacles to receive a plurality of electrical connectors. The CPA member is a staged CPA that has bi-directional movement in a direction perpendicular to the mating axes of male connectors mated to coupled female connectors. The CPA member is movable between a pre-stage and a final stage position laterally along the support frame perpendicular to the mating axes of the connectors. The pre-stage position allows the male connectors to be mated to the coupled female connectors and also allows unmating of the connectors when the CPA member is further engaged in an opening of the CPA member with a tool. The tool is used a lever by a human operator apply a force to the CPA member so that connecting tabs of the CPA member deflect and thus engage the lock arms of the coupled first connectors so that the lock arms decouple from the inclined ramps of the male connectors allowing the male connectors to be unmatable from the coupled female connectors. When disposed in the final stage position, the CPA member prevents multiple male connectors from being unmated from the corresponding coupled female connectors. The inclined ramps of the male connectors remain disposed in the elongate holes of the lock arms of the coupled first connectors to ensure the male connectors remain fully mated to the coupled female connectors. The plurality of receptacles are constructed in the support frame to form a row perpendicular to the mating axes of the connectors and the CPA member is advantageously disposed along a length of the support frame adjacent the row to conveniently keep the fully mated connectors mated. A detent of the CPA member is engagable in cutouts in the support frame to properly position the CPA member in the respective pre-stage and final stage positions.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A ganged electrical connection system comprising:

a plurality of first connectors matable to a plurality of second connectors along mating axes;

a connector position assurance (CPA) member, and the CPA member includes, a plurality of tabs, and a plurality of release fingers, and the plurality of first connectors include a plurality of lock arms and the plurality of second connectors include a plurality of inclined ramps, wherein said plurality of tabs receive said plurality of lock arms and said plurality of inclined ramps deflectingly engage said plurality of release fingers to allow movement of the CPA member to a position of the CPA member, that when disposed in said position, keeps the plurality of second connectors from unmating from the plurality of coupled first connectors.

2. The ganged electrical connection system according to claim 1, wherein said position is a final stage position and the CPA member further comprises a pre-stage position, and when the CPA is moved to the final stage position the CPA member is moved in a first direction, and when the CPA member is moved away from the final stage position to the pre-stage position remote from the final stage position the CPA member is moved in a second direction opposite the first direction, and when the CPA member is disposed in said pre-stage position, the plurality of second connectors are unmatable from the plurality of first connectors.

3. The ganged electrical connection system according to claim 2, wherein said first direction and said second direction are respectively generally perpendicular to the mating axes.

4. The ganged electrical connection system according to claim 2, wherein when the CPA member is disposed in the pre-stage position and a force is sufficiently applied to the CPA member, the plurality of second connectors are unmatable from the plurality of first connectors.

5. The ganged electrical connection system according to claim 4, wherein said force is applied the plurality of tabs engage against the plurality of lock arms so that the plurality of second connectors are unmatable from the plurality of first connectors.

6. The ganged electrical connection system according to claim 4, wherein the force is applied with a tool.

7. The ganged electrical connection system according to claim 4, wherein the CPA member comprises a pump handle and the force is applied using the pump handle.

8. The ganged electrical connection system according to claim 1, further including, an arrangement with the CPA member attached thereto, the arrangement further including a plurality of receptacles and the plurality of first connectors are receivably coupled in the plurality of receptacles, and the plurality of second connectors are matable to the plurality of coupled first connectors.

9. The ganged electrical connection system according to claim 8, wherein said plurality of receptacles are formed in a row on the arrangement, and said plurality of first connectors are receivably coupled in the plurality of receptacles in said row, and the CPA member has movement between the position, wherein the position is a final stage position, and a pre-stage position adjacent said row.

10. The ganged electrical connection system according to claim 9, wherein said movement of the CPA member is generally perpendicular to the mating axes.

11. The ganged electrical connection system according to claim 9, wherein the CPA member is disposed in a pre-stage position a force is sufficiently applied against the CPA member in a manner that deflects the plurality of lock arms so that the plurality of second connectors are unmatable from the plurality of coupled first connectors.

12. The ganged electrical connection system according to claim 11, wherein said force is applied with a tool.

13. The ganged electrical connection system according to claim 11, wherein the CPA member comprises a pump handle and the force is applied using the pump handle.

14. The ganged electrical connection system according to claim 8, wherein the plurality of coupled first connectors floatingly move within the plurality of receptacles so as to absorb positional mating tolerance variation manifested at each receptacle in the plurality of receptacles when the plurality of second connectors are mated to the plurality of coupled first connectors.

15. An electrical connection system comprising:

at least one first connector matable to at least one second connector along a mating axis, the at least one first connector including a at least one lock arm; and a connector position assurance (CPA) member including at least one release finger;

wherein the at least one release finger of the CPA member communicates with the at least one lock arm and when the at least one second connector fully mates with the at least one first connector the at least one second connector communicates with the at least one release finger so as to deflect the at least one release finger in a manner that enables movement of the CPA member into a position relative to the mated connectors transverse to the axis, such that when the CPA member is disposed in said position, prevents said mated connectors from unmating.

16. A method of fabricating an electrical connection system, comprising:

using at least one first connector and at least one second connector matable to the at least one first connector along a mating axis, and the connector position assurance (CPA) member communicates with a lock arm disposed on the at least one first connector, and when the at least one second connector is fully mated to the at least one first connector the at least one second connector communicates collectively with the CPA member and the at least one first connector so that the CPA member is movable to a position relative to the at least one first and the at least one second connector transverse to the mating axis, such that when the CPA member is disposed in said position, prevents the at least one second connector from unmating from the at least one first connector.

17. A method of fabricating an electrical connection system, comprising:

using a plurality of first connector housings and a plurality of second connector housings matable to the plurality of first connector housings along mating axes so that when the plurality of second connector housings are mated to the plurality of first connector housings the plurality of second connector housings communicate with the plurality of first connector housings and a connector position assurance (CPA) member in a manner so that the CPA member is movable to a position relative to the plurality of first connector housings and the plurality of second connector housings, such that when the CPA member is disposed in said position, prevents the plurality of second connector housings from unmating from the plurality of first connector housings.

18. The method according to claim 17, wherein the CPA member is moveable to said position relative to said plurality of first connector housings and said plurality of second connector housings in a direction that is transverse to said mating axes.

19. The method according to claim 17, wherein the CPA member defines an opening that receives a tool that applies a force thereto, said applied force being sufficient to decouple a plurality of lock arms from a plurality of lock ramps so that the plurality of second connector housings are unmatable from the plurality of first connector housings.

20. An electrical connection system comprising:

a plurality of first connectors matable to a plurality of second connectors along mating axes;

a connector position assurance (CPA) member, and the CPA member includes, a plurality of tabs, and a plurality of release fingers, and the plurality of first connectors include a plurality of lock arms and the plurality of second connectors include a plurality of inclined ramps, wherein said plurality of tabs receive said plurality of lock arms and said plurality of inclined ramps deflectingly engage said plurality of release fingers to allow movement of the CPA member to a position of the CPA member, that when disposed in said position, keeps the plurality of second connectors from unmating from the plurality of coupled first connectors.

* * * * *